US010306956B2

(12) United States Patent
Rich et al.

(10) Patent No.: US 10,306,956 B2
(45) Date of Patent: Jun. 4, 2019

(54) FRIENDSHIP BRACELET

(71) Applicants: Michael James Rich, Mandeville, LA (US); William Womack, Covington, LA (US)

(72) Inventors: Michael James Rich, Mandeville, LA (US); William Womack, Covington, LA (US)

( * ) Notice: Subject to any disclaimer, the term of this patent is extended or adjusted under 35 U.S.C. 154(b) by 64 days.

(21) Appl. No.: 13/680,033

(22) Filed: Nov. 17, 2012

(65) Prior Publication Data

US 2014/0137600 A1 May 22, 2014

(51) Int. Cl.
*A44C 5/00* (2006.01)
*A44C 9/00* (2006.01)
*G09F 3/00* (2006.01)

(52) U.S. Cl.
CPC ..... *A44C 5/0053* (2013.01); *A44C 5/0069* (2013.01); *G09F 3/005* (2013.01)

(58) Field of Classification Search
CPC ..... A44C 5/0007; A44C 5/00; A44C 5/0023; A44C 9/00; A44C 9/0053; A44C 9/0038
USPC ..... 63/3, 11
See application file for complete search history.

(56) References Cited

U.S. PATENT DOCUMENTS

2012/0159988 A1* 6/2012 Baird ..... A44C 5/102 63/11
2014/0116086 A1* 5/2014 Casaccio ..... A44C 5/0053 63/5.1

* cited by examiner

*Primary Examiner* — Jack W Lavinder

(57) ABSTRACT

According to one embodiment of the present invention a Friendship bracelet that appears as one but can be torn into two individual bracelets for each friend to wear and be connected to each other is disclosed. The invention described here allows a proper link between both friends who wear half of the bracelet. The result is a proper symbol that connects two friends to each other by wearing half of a bracelet that used to be one single bracelet before being torn in two. The friendship bracelet according to another embodiment of the present invention that appears as one but can be torn into a plurality of individual bracelets for each friend in a group to wear and be connected to one another is also disclosed.

8 Claims, 7 Drawing Sheets

FRIENDSHIP BRACELET

REFERENCE TO RELATED APPLICATIONS

This patent application claims the benefit of U.S. Provisional Application No. 61/611,396 filed on Mar. 15, 2012, the disclosure of which is incorporated herein by reference in its entirety.

BACKGROUND OF THE INVENTION

Field of the Invention

This invention relates generally to a friendship bracelet, and relates more particularly to a friendship bracelet that appears as one but can be torn into two or more individual bracelets for each friend to wear so they can be connected to one another symbolically as sharing a common portion of the device between each of them.

Description of Related Art

For centuries people have always worn symbols of friendship around their wrist. However, friendship bracelets are always one-sided with one friend handing another friend a single bracelet to symbolize an effective visual unity and connect the two friends together. Because it was a one-way system, after a while, the friendship bracelet could never be traced back to the friend who gave them the bracelet.

Therefore, there is a need for improved friendship bracelets that can provide a proper link between or among friends who wear the friendship bracelets.

The invention described here allows a proper link between two friends who wear half of the bracelet. The result is a proper symbol that connects two friends to each other by wearing half of a bracelet that used to be one single bracelet before torn into two. The invention described here also allows a proper link among a group of friends who wear a part of the bracelet that used to be one single bracelet before being torn into several pieces.

SUMMARY OF THE INVENTION

As stated above, for centuries people have always worn symbols of friendship and unity around their wrist that could never be traced back to the friend who gave them the bracelet to symbolize an effective visual unity. The invention claimed here solves this problem.

This bracelet allows friends to symbolize their unity of friendship by displaying their bracelet that became two or more pieces, but torn from the same bracelet, which in turn symbolizes a link between or among the friends who are wearing the bracelets.

The claimed invention differs from what currently exists. Prior to this invention, the only way to symbolize your friendship was a one-way system with just giving your friend a single bracelet. There is no unity or proper symbolism like when friendship bracelets are from the same bracelet, connecting two or more friends in a symbolic gesture. This present invention, allows an effective symbol of friendship, being that both or more friends are connected by one half or one part of a bracelet that each is wearing.

The invention described here allows a proper link between two or more friends who wear half or a part of the bracelet. The result is a proper symbol that connects two or more friends to each other by wearing half or a part of a bracelet that used to be one single bracelet before being torn into two or more pieces. The friendship bracelet of the present invention produces two or more individual bracelets, stemming from one bracelet.

In an exemplary embodiment of the present invention, there is disclosed a friendship bracelet made of resilient and flexible material, preferably made of silicone. The friendship bracelet of the present invention has at least one indented track around the inside of the bracelet and one small opening at one part of the indented track so that an individual can put fingers inside the small opening and tear the bracelet apart along the indented track. In one embodiment, the bracelet has one indented track and a small opening so that the bracelet can be torn into two identical bracelets. Place one bracelet on one's wrist and give the friend the other identical one to symbolize a friendship connection between each other.

In another embodiment, the bracelet has more than one indented tracks and openings so that the bracelet can be torn into more than two identical bracelets which can be worn by a group of friends to symbolize their friendship.

The friendship bracelet can be sized and configured to be worn as a wrist bracelet, an ankle bracelet, or a necklace or as a ring.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

The friendship bracelet according to the present invention is made of resilient and flexible material, preferably made of silicone. The friendship bracelet of the present invention has at least one indented track around the inside of the bracelet and one small opening at a part of each of the indented tracks.

Figure 1:
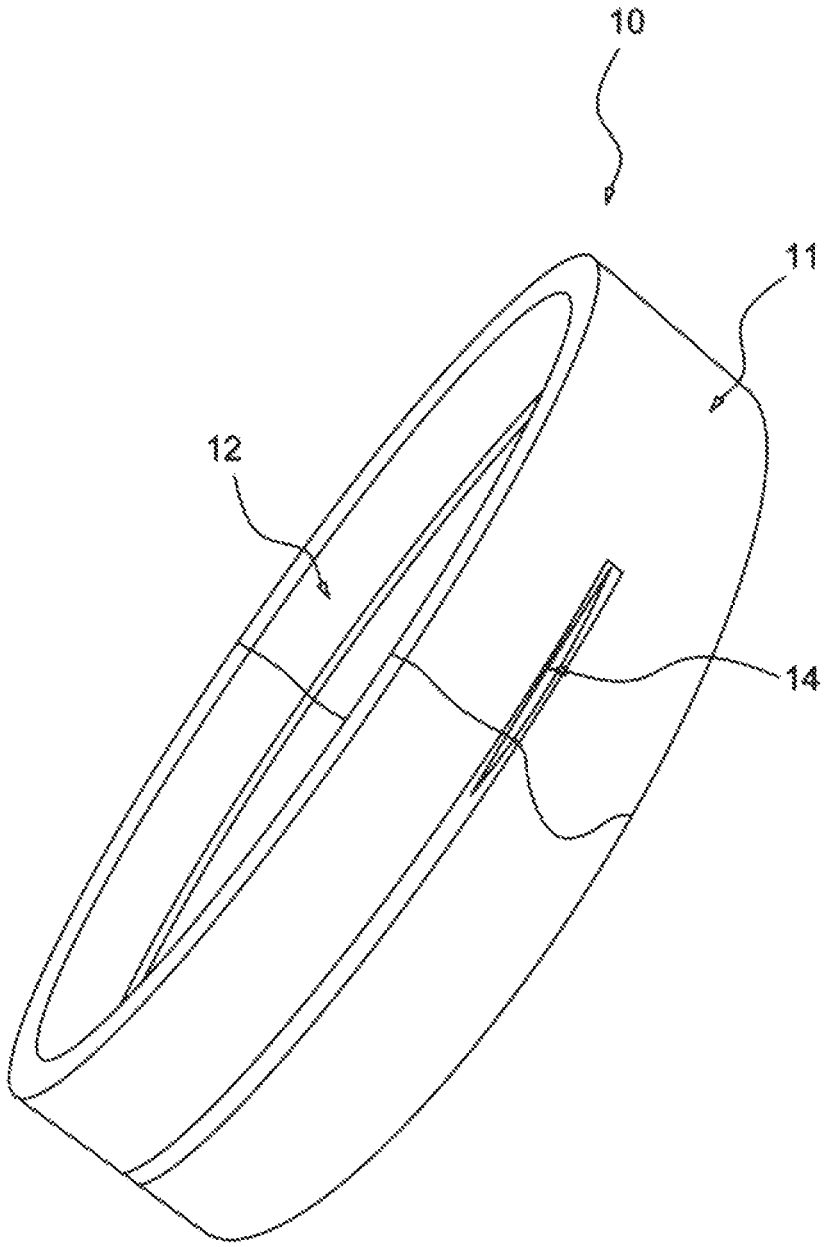
FIG. 1 is a perspective isomeric side view of a friendship bracelet before separation according to one embodiment of the present invention.
Figure 2:
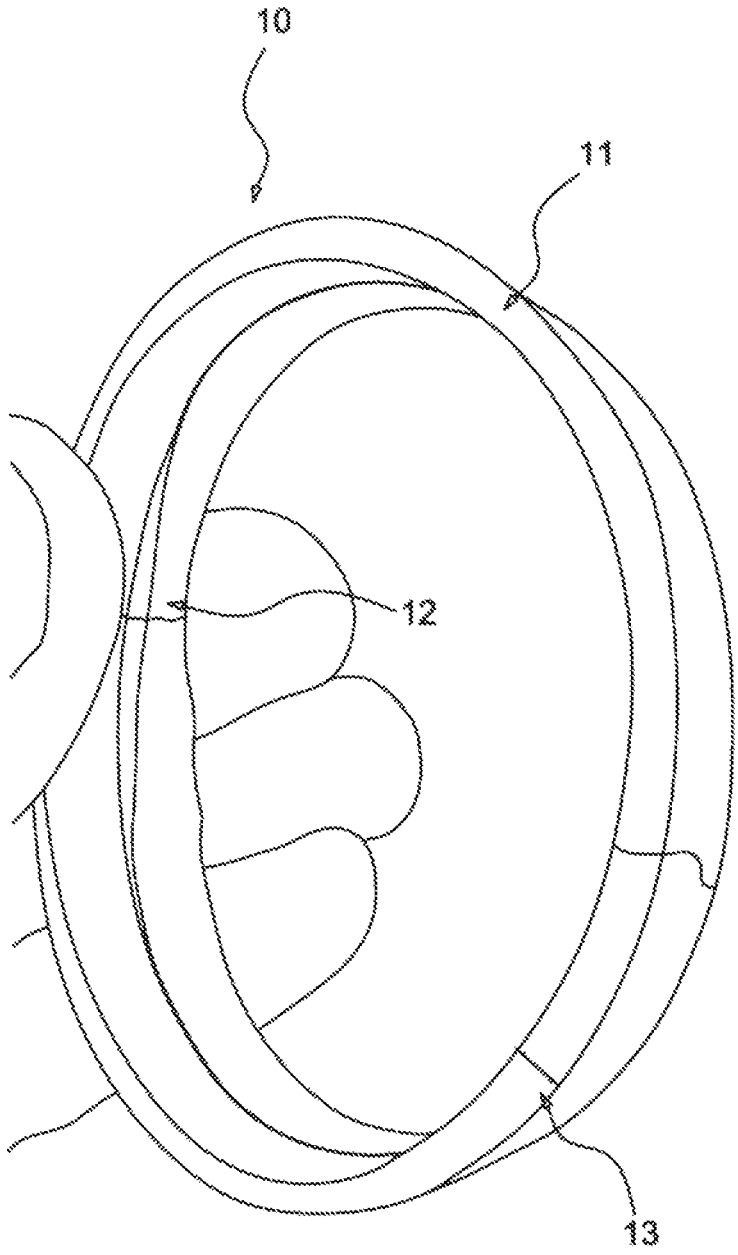
FIG. 2 is a perspective isomeric top view of the friendship bracelet before separation showing an indented track along the mid-line of the inside of the friendship bracelet.
Figure 3:
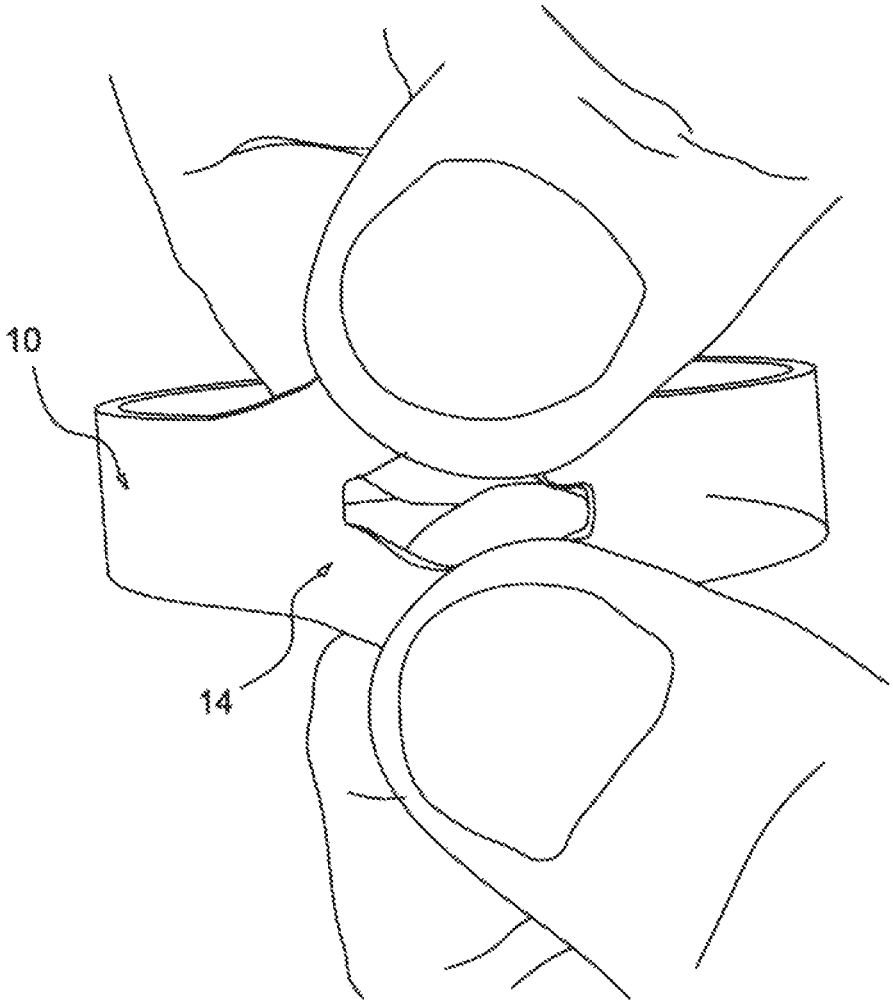
FIG. 3 is a perspective side view of the friendship bracelet showing a complete small opening at a point along the indented track.
Figure 4:
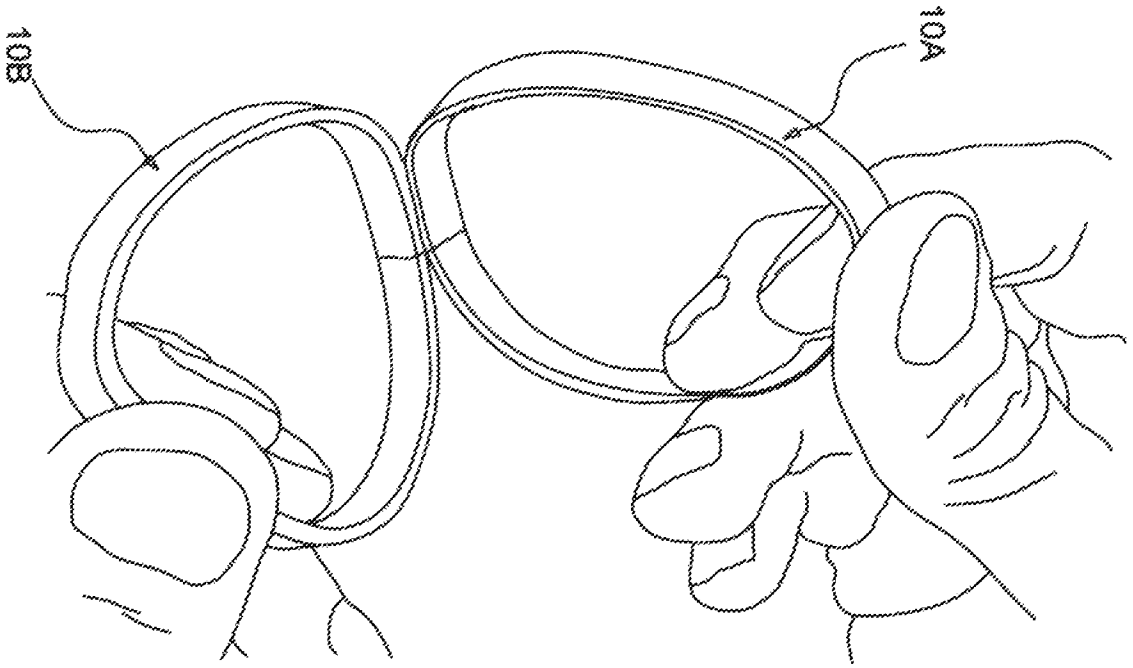
FIG. 4 is a perspective view of the friendship bracelet which is torn apart along the indented track.
Figure 5:
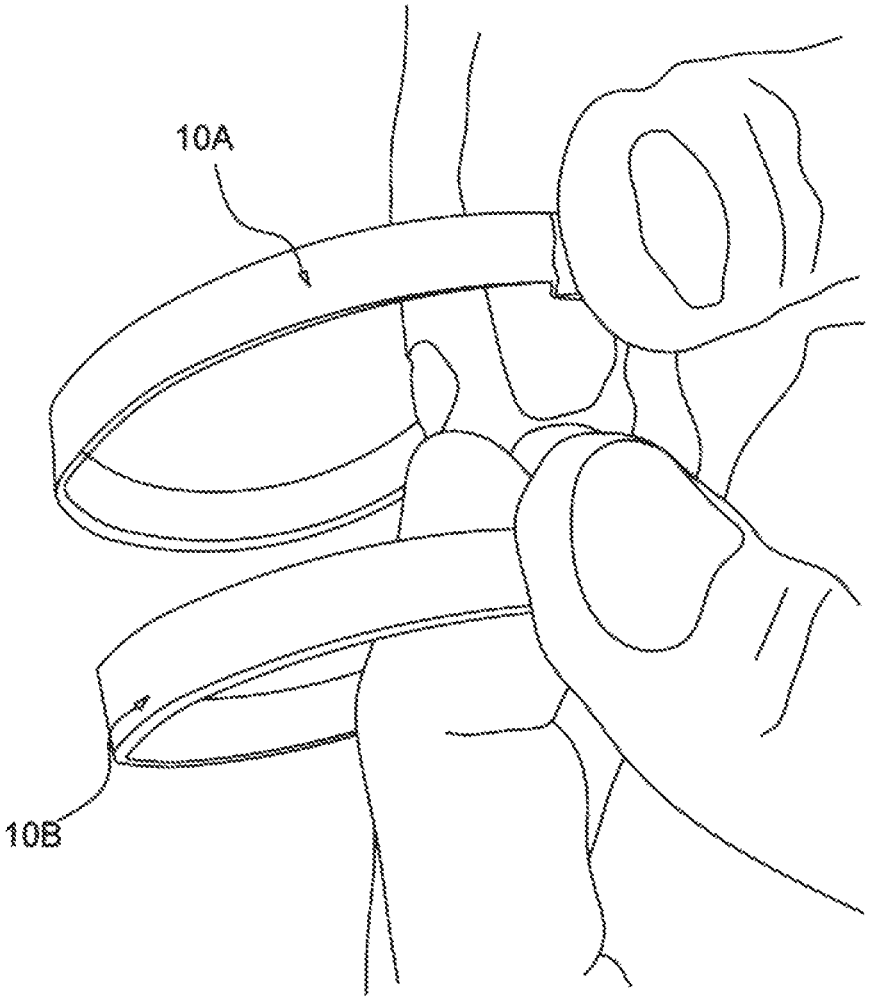
FIG. 5 is a perspective view of the friendship bracelet which have been torn apart and become two separate identical bracelets to be shared by two friends.

Referring to FIGS. 1-2, there is disclosed a friendship bracelet before separation according to one embodiment of the present invention. The friendship bracelet generally designated by a reference numeral 10 according to the first embodiment is designed to be worn by two friends after it is torn into two bracelets. The friendship bracelet 10 according to this embodiment comprises a silicone circle 11 and one indented track 12 located along the mid-line around the entire inside of the silicone circle 11. The indented track is approximately 90% deep into the depth 13 of the silicone circuit 11 to endorse a smooth and even separation from each other. The bracelet 10 also has a complete small opening 14 at a part along the indented track 12 so that an individual can put fingers inside the 'complete small opening 14' on the bracelet and begin to tear the bracelet 10 apart along the indented track 12 as demonstrated in FIG. 3. Continue pulling until both sides of the bracelet are completely separated, making two total bracelets. FIG. 4 is a perspective view of the friendship bracelet 10 which is torn apart along the indented track 12 but still connected. FIG. 5 is a perspective view of the friendship bracelet 10 which have been torn apart and became two separate identical bracelets 10A and 10B to be worn by two friends.

Figure 6:
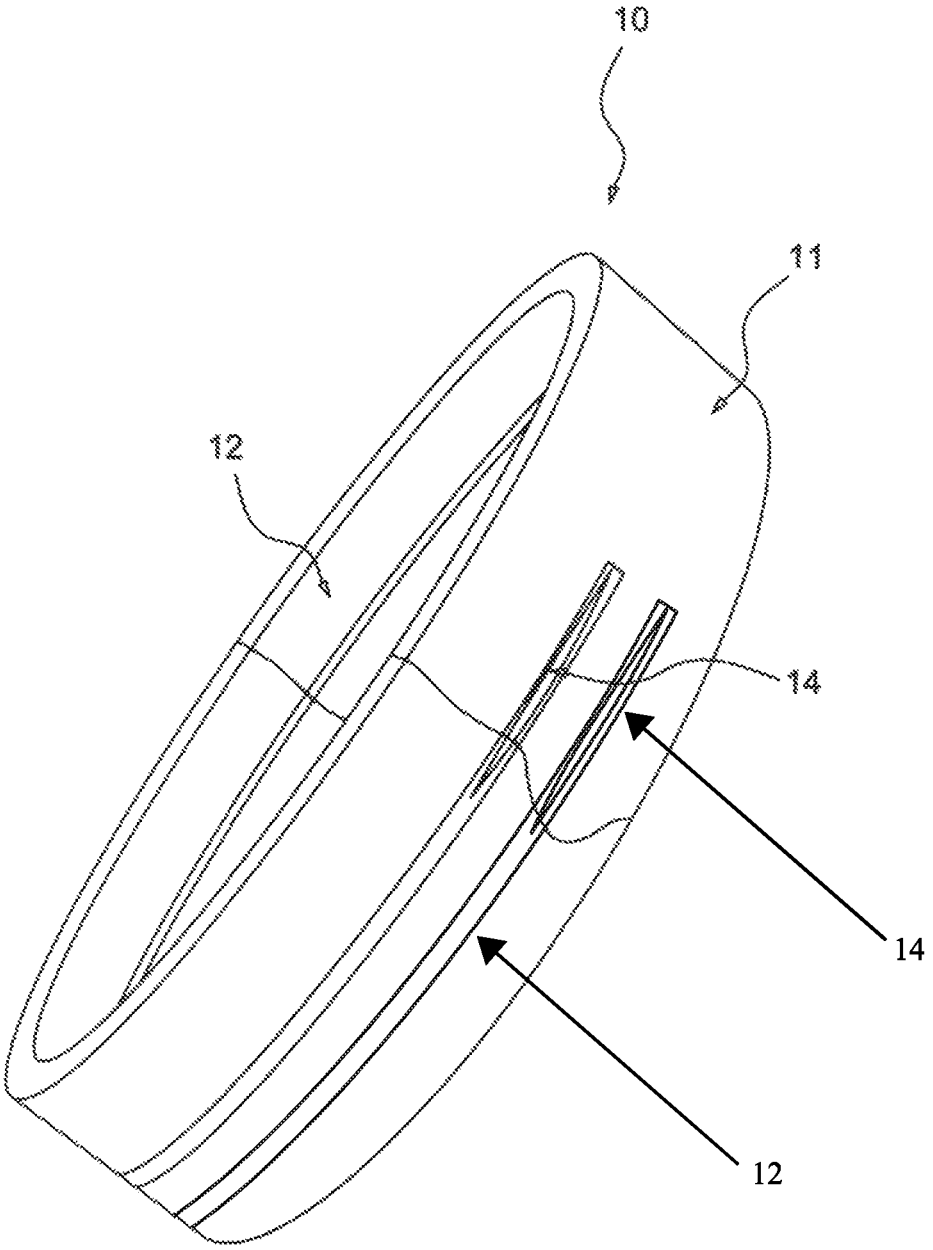
FIG. 6 is a perspective view of a friendship bracelet which has a plurality of indented tracks around the inside of the bracelet according to another embodiment of the present invention.
Figure 7:
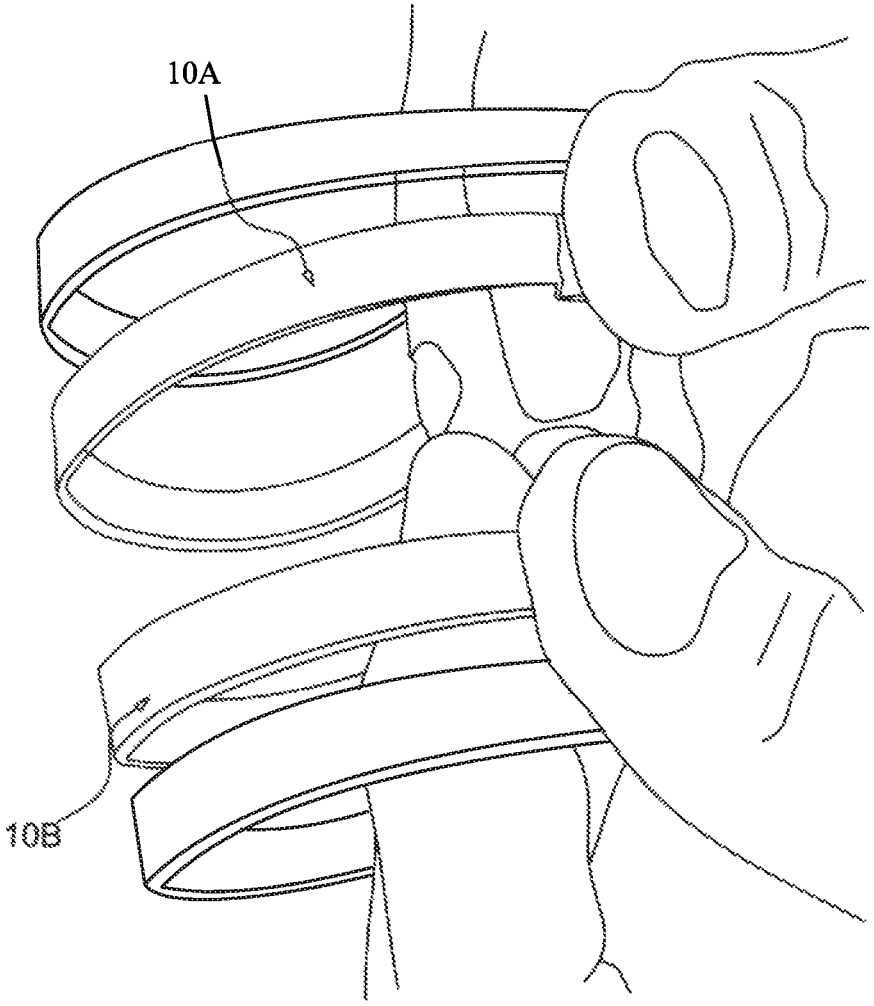
FIG. 7 is a perspective view of the friendship bracelet which have been torn apart and become a plurality of separate identical bracelets to be shared by a group of friends.

Referring to FIGS. 6-7 there is disclosed another embodiment of the friendship bracelet 10 according to the present invention. This embodiment is designed for a group of friends who can wear the identical individual bracelets that are stemmed from the same single bracelet. The friendship bracelet 10 in FIG. 6 has a plurality of indented tracks 12 and small openings around the inside of the silicone circuit 11. FIG. 7 is a perspective view of the friendship bracelet 10 which has been torn apart and became a plurality of separate identical bracelets to be worn by a group of friends.

A method for making a friendship bracelet comprising steps of creating a mold for the silicone to be inserted with the 'complete small opening' and the '90% indented track'. After the silicone is cooled down and can be taken out of the mold, a precise cut is initiated on the 'complete small opening' to prevent the silicone from breaking from the initial tear.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are entitled.

What is claimed is:

1. A friendship bracelet comprising:

a circle;

the circle being made of a resilient material;

an indented track;

the indented track being annularly located along an inside of the circle so as to guide a clean even tear entirely around the circle and for making the circle into two separate identical parts; and a complete small opening;

the complete small opening being located at one point of the indented track for allowing an individual to put fingers inside and to begin to tear the circle into the two separate identical parts by pulling the circle apart along the indented track; and the circle being capable of being worn as one single bracelet before separation and being capable of being separated into the two separate identical parts and worn by two friends so as to symbolize a friendship.

2. The friendship bracelet of claim 1, wherein the friendship bracelet is sized and configured to be worn as a wrist bracelet, an ankle bracelet or a necklace.

3. The friendship bracelet of claim 1, wherein the resilient material is a silicone material.

4. The friendship bracelet of claim 1, wherein the indented track is approximately 90% deep into a depth of the circle so as to endorse a smooth and even separation.

5. A friendship bracelet comprising:

a circle;

the circle being made of a resilient material;

at least two indented tracks;

the at least two indented tracks being parallel to each other;

each of the at least two indented tracks being annularly located along an inside of the circle so as to guide at least two clean even tears entirely around the circle and for making the circle into at least three separate identical parts; and at least two complete small openings;

a corresponding complete small opening among the at least two small openings being located at one point of a corresponding indented track among the at least two indented tracks for allowing an individual to put fingers inside and to begin to tear the circle into the at least three separate identical parts by pulling the circle apart along the at least two indented tracks; and the circle being capable of being worn as one single bracelet before separation and being capable of being separated into the at least three separate identical parts and worn by at least three friends so as to symbolize a friendship.

6. The friendship bracelet of claim 5, wherein the friendship bracelet is configured to be worn as a wrist bracelet, an ankle bracelet or a necklace.

7. The friendship bracelet of claim 5, wherein the resilient material is a silicone material.

8. The friendship bracelet of claim 5, wherein each of the at least two indented tracks is approximately 90% deep into a depth of the circle to endorse a smooth and even separation.

* * * * *